US010525707B2

(12) United States Patent
Nakayama et al.

(10) Patent No.: US 10,525,707 B2
(45) Date of Patent: Jan. 7, 2020

(54) LIQUID EJECTING HEAD, LIQUID EJECTING APPARATUS, AND PIEZOELECTRIC DEVICE

(71) Applicant: SEIKO EPSON CORPORATION, Tokyo (JP)

(72) Inventors: Masao Nakayama, Shiojiri (JP); Shunya Fukuda, Azumino (JP); Eiju Hirai, Azumino (JP); Shiro Yazaki, Chino (JP); Hajime Nakao, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/127,758

(22) Filed: Sep. 11, 2018

(65) Prior Publication Data

US 2019/0077149 A1 Mar. 14, 2019

(30) Foreign Application Priority Data

Sep. 13, 2017 (JP) ..... 2017-175476

(51) Int. Cl.
*B41J 2/14* (2006.01)

(52) U.S. Cl.
CPC .. *B41J 2/14233* (2013.01); *B41J 2002/14306* (2013.01)

(58) Field of Classification Search
None
See application file for complete search history.

(56) References Cited

U.S. PATENT DOCUMENTS

2001/0040298 A1* 11/2001 Baba ..... H01L 21/56 257/778
2013/0105959 A1* 5/2013 Baillin ..... B81C 1/00285 257/682

FOREIGN PATENT DOCUMENTS

JP 2017-24334 A 2/2017
JP 2017024334 A * 2/2017

* cited by examiner

*Primary Examiner* — Erica S Lin
(74) *Attorney, Agent, or Firm* — Workman Nydegger

(57) ABSTRACT

A liquid ejecting head includes a flow path forming substrate, a vibration plate that is formed on one surface side of the flow path forming substrate, a plurality of piezoelectric elements that are provided on the vibration plate, a protective substrate that is bonded to the one surface side of the flow path forming substrate and has a flow path, a flow path member that is bonded to a side of the protective substrate opposite to the flow path forming substrate, a drive circuit that is mounted in a space formed so as to be surrounded by the flow path forming substrate, the protective substrate, and the flow path member, a filler that is filled between the drive circuit and the protective substrate, and a protective film that is formed on an inner wall, in which the protective film has an exposure hole exposing a surface of the filler.

11 Claims, 10 Drawing Sheets

LIQUID EJECTING HEAD, LIQUID EJECTING APPARATUS, AND PIEZOELECTRIC DEVICE

The entire disclosure of Japanese Patent Application No. 2017-175476, filed Sep. 13, 2017 is expressly incorporated by reference herein.

BACKGROUND

1. Technical Field

The present invention relates to a liquid ejecting head that ejects a liquid, a liquid ejecting apparatus including the liquid ejecting head, and a piezoelectric device including a piezoelectric element.

2. Related Art

As a piezoelectric device used in an ink jet type recording head which is a typical example of a liquid ejecting head, there is a device including an individual flow path communicating with a nozzle, a flow path forming substrate provided with a liquid supply chamber communicating with the individual flow path, and a piezoelectric element provided on one surface side of the flow path forming substrate via a vibration plate.

An ink jet type recording head having such a piezoelectric device has been proposed in which a drive circuit for driving a piezoelectric element is directly mounted on a flow path forming substrate (for example, refer to JP-A-2017-24334).

However, if a filler such as an underfill agent provided between a drive circuit and a flow path forming substrate is covered with a protective film for protecting the flow path forming substrate from ink, the gas emitted from the filler is not discharged to the outside, so that contamination occurs on a surface of a wiring connected to a terminal and a terminal of the drive circuit, so that there is a problem that short-circuiting or dielectric breakdown of the wiring is likely to occur.

In addition, there is a problem that adhesion of the bonding surface between the drive circuit and the flow path forming substrate deteriorates due to the gas emitted from the filler and migration is likely to occur.

Such a problem is not limited to a liquid ejecting head represented by an ink jet type recording head, and also exists in a piezoelectric device other than the liquid ejecting head.

SUMMARY

An advantage of some aspects of the invention is to provide a liquid ejecting head, a liquid ejecting apparatus, and a piezoelectric device capable of inhibiting problems such as short-circuiting, dielectric breakdown, and migration of wiring due to gas by discharging the gas emitted from a filler to an outside.

According to an aspect of the invention, there is provided a liquid ejecting head including a nozzle plate on which a first nozzle row including a first nozzle ejecting a liquid and a second nozzle row including a second nozzle ejecting a liquid are formed, a flow path forming substrate on which a first pressure generation chamber communicating with the first nozzle and a second pressure generation chamber communicating with the second nozzle are formed, a vibration plate that is formed on one surface side of the flow path forming substrate, a first piezoelectric element that is provided on the vibration plate at a position corresponding to the first pressure generation chamber, a second piezoelectric element that is provided on the vibration plate at a position corresponding to the second pressure generation chamber, a protective substrate that is bonded to the one surface side of the flow path forming substrate and has a flow path, a flow path member that is bonded to a side of the protective substrate opposite to the flow path forming substrate, a drive circuit that is mounted in a space formed so as to be surrounded by the flow path forming substrate, the protective substrate, and the flow path member, between the first piezoelectric element and the second piezoelectric element of the flow path forming substrate to drive the first piezoelectric element and the second piezoelectric element, a filler that is filled between the drive circuit and the flow path forming substrate, and between the drive circuit and the protective substrate, and a protective film that is formed from an inner wall of the flow path of the protective substrate to a boundary side with at least the inner wall of a bonding surface of the protective substrate with the flow path member, in which the protective film has an exposure hole exposing at least a portion of a surface of the filler.

In this case, the exposure hole is provided in the protective film, so that the gas emitted from the filler can be discharged from the exposure hole into the space. Therefore, the gas emitted from the filler is inhibited from moving to the terminal portion of the drive circuit and the bonding interface between the drive circuit and the flow path forming substrate, so that it is possible to inhibit contamination of the terminal portion by the gas and to inhibit migration due to poor adhesion at the bonding interface.

In the liquid ejecting head, it is preferable that the protective film extend to a portion of the surface of the filler, and the exposure hole expose a portion of the surface of the filler. In this case, it is possible to inhibit the drive circuit and the like from being etched even if a positional deviation of the mask is occurred when the protective film is etched to form the exposure hole.

In the liquid ejecting head, the exposure hole may be formed to have a size that exposes an entire surface of the surface of the filler. In this case, it is possible to reliably discharge the gas discharged from the filler through the exposure hole by increasing the opening area of the exposure hole.

In the liquid ejecting head, it is preferable that the protective film formed on the bonding surface of the protective substrate with the flow path member have a plurality of recessed portions. In this case, the recessed portion is provided on the bonding surface of the protective film with the flow path member, so that the bonding area between the protective substrate and the flow path member is increased and the bonding strength between the protective substrate and the flow path member can be improved by an anchor effect. In addition, by providing the recessed portion, the bonding interface from the flow path of the protective substrate to the space is increased, and the penetration of the liquid into the space via the bonding interface can be inhibited.

In the liquid ejecting head, it is preferable that the space where the drive circuit is disposed be open to an atmosphere. In this case, the gas discharged from the filler via the exposure hole can be discharged from the space to the outside, and it is difficult for the gas to further move to a terminal portion of the drive circuit or the bonding interface side between the drive circuit and the flow path forming substrate.

In the liquid ejecting head, it is preferable that an adsorbent that absorbs gas generated from the filler be provided in the space where the drive circuit be disposed. In this case, the gas discharged from the filler via the exposure hole can be adsorbed by the adsorbent, and it is difficult for the gas to further move to the terminal portion of the drive circuit or the bonding interface side between the drive circuit and the flow path forming substrate.

According to another aspect of the invention, there is provided a liquid ejecting apparatus including the above-described liquid ejecting head.

In this case, it is possible to realize the liquid ejecting apparatus in which problems such as short-circuiting, dielectric breakdown, and migration of wiring due to the gas discharged from the filler are inhibited.

According to still another aspect of the invention, there is provided a piezoelectric device which is used in a liquid ejecting head, the device including a flow path forming substrate on which a first recessed portion and a second recessed portion are formed, a vibration plate that is formed on one surface side of the flow path forming substrate, a first piezoelectric element that is provided on the vibration plate at a position corresponding to the first recessed portion, a second piezoelectric element that is provided on the vibration plate at a position corresponding to the second recessed portion, a protective substrate that is bonded to the one surface side of the flow path forming substrate and has a flow path, a flow path member that is bonded to a side of the protective substrate opposite to the flow path forming substrate, a drive circuit that is mounted in a space formed so as to be surrounded by the flow path forming substrate, the protective substrate, and the flow path member, between the first piezoelectric element and the second piezoelectric element of the flow path forming substrate to drive the first piezoelectric element and the second piezoelectric element, a filler that is filled between the drive circuit and the flow path forming substrate, and between the drive circuit and the protective substrate, and a protective film that is formed from an inner wall of the flow path of the protective substrate to a boundary side with at least the inner wall of a bonding surface of the protective substrate with the flow path member, in which the protective film has an exposure hole exposing at least a portion of a surface of the filler.

In this case, the exposure hole is provided in the protective film, so that the gas emitted from the filler can be discharged from the exposure hole into the space. Therefore, the gas emitted from the filler is inhibited from moving to the terminal portion of the drive circuit and the bonding interface between the drive circuit and the flow path forming substrate, so that it is possible to inhibit contamination of the terminal portion by the gas and to inhibit migration due to poor adhesion at the bonding interface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
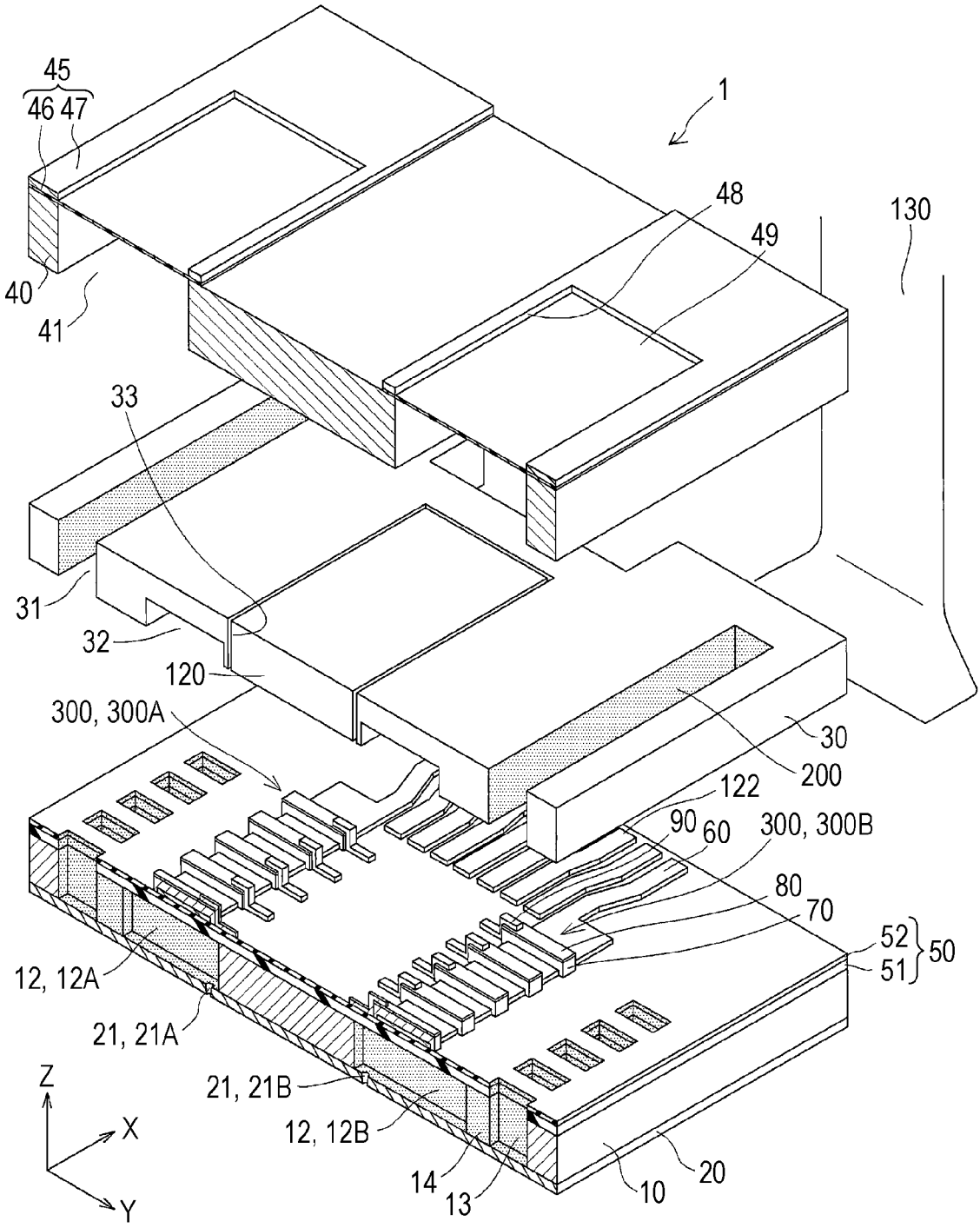
FIG. 1 is an exploded perspective view of a recording head according to Embodiment 1 of the invention.

Hereinafter, the invention will be described with reference to the drawings. However, the following description shows one embodiment of the invention, and it can be arbitrarily changed within the scope of the invention. In the drawings, the same reference numerals are given to the same members, and explanations thereof are omitted as appropriate. In addition, in each drawing, X, Y, and Z represent three spatial axes orthogonal to each other. In the specification, directions along these axes will be described as a first direction X, a second direction Y, and a third direction Z.

Embodiment 1

Figure 2:
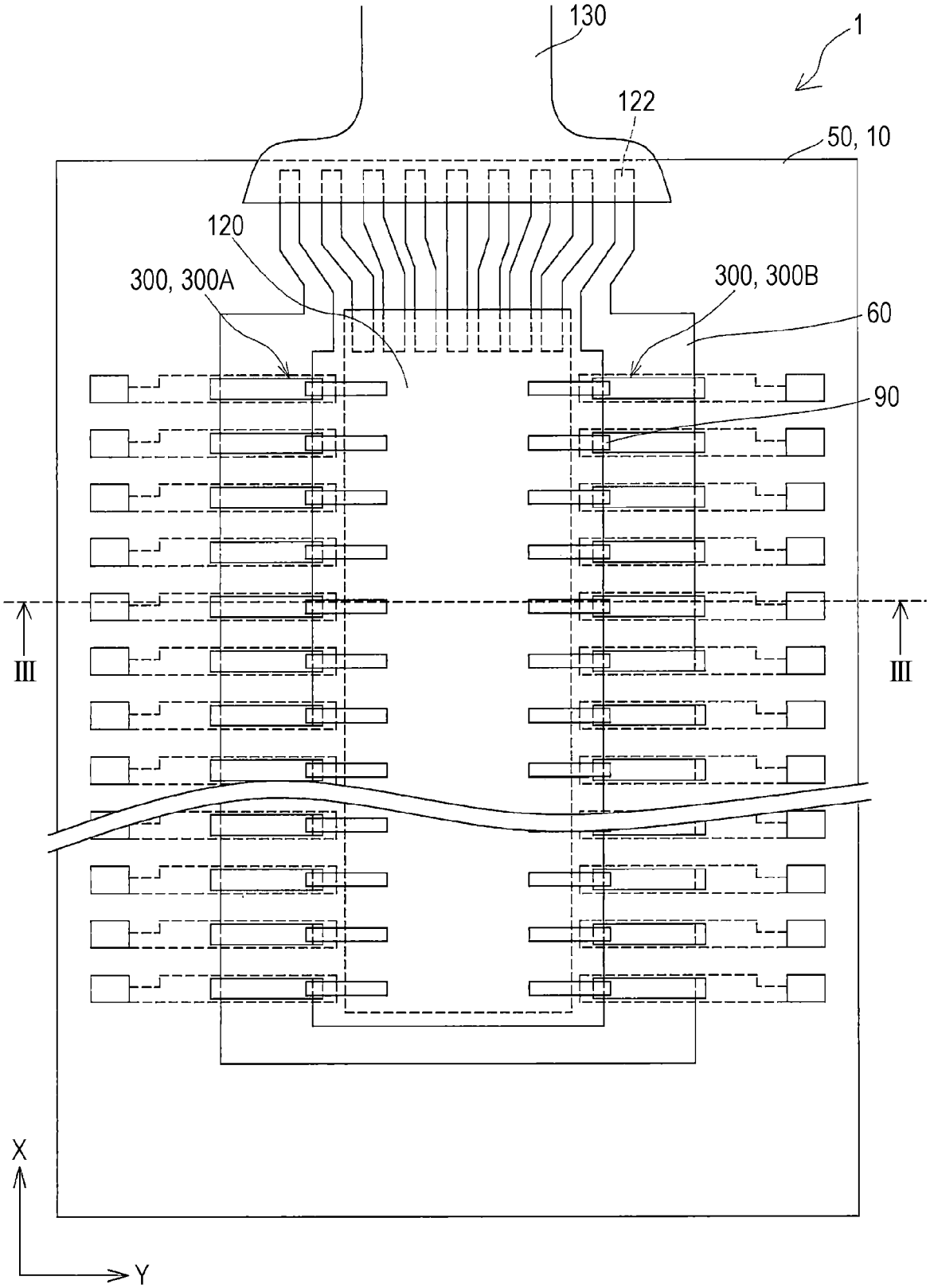
FIG. 2 is a plan view of a main part of the recording head according to Embodiment 1 of the invention.
Figure 3:
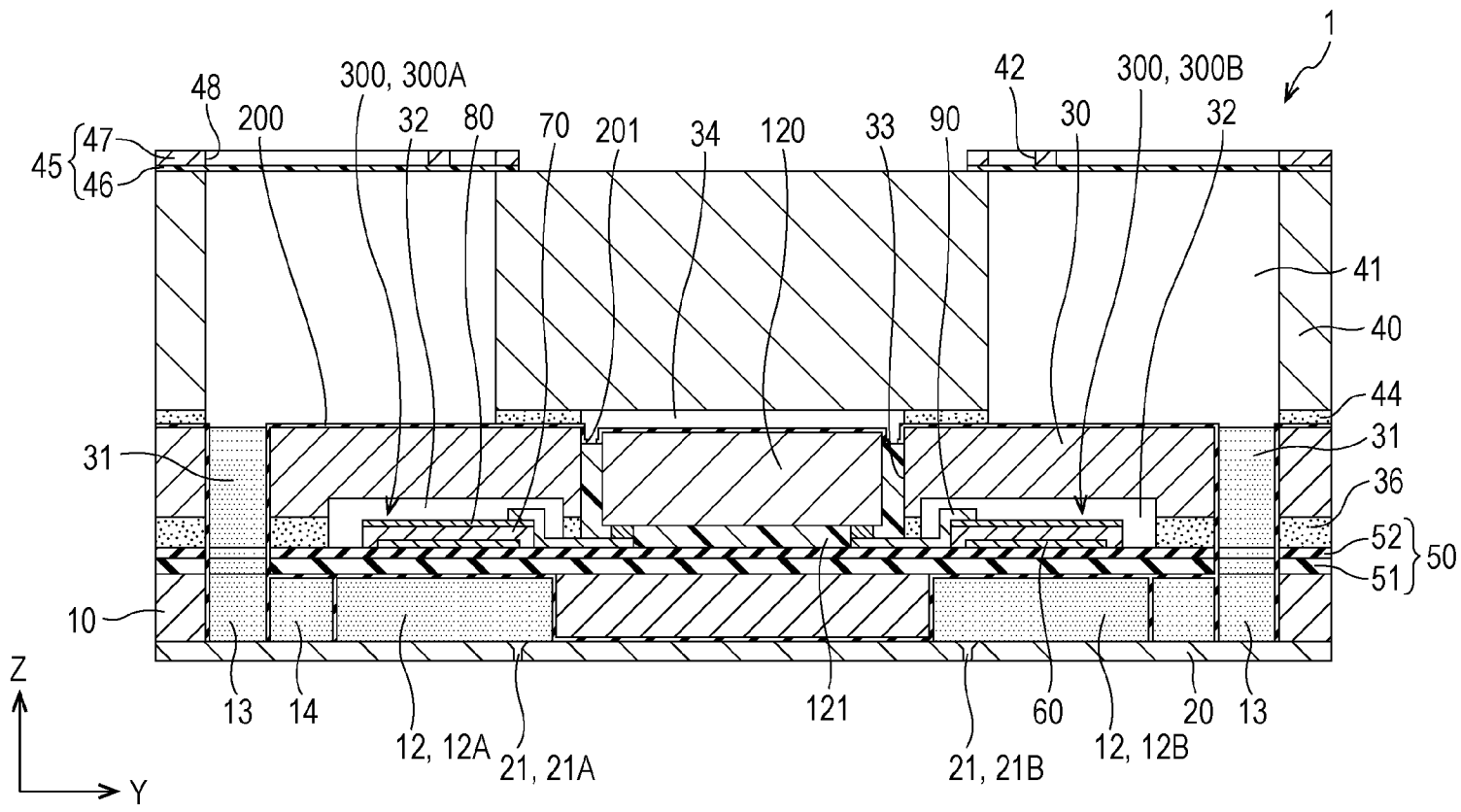
FIG. 3 is a cross-sectional view of the recording head according to Embodiment 1 of the invention.
Figure 4:
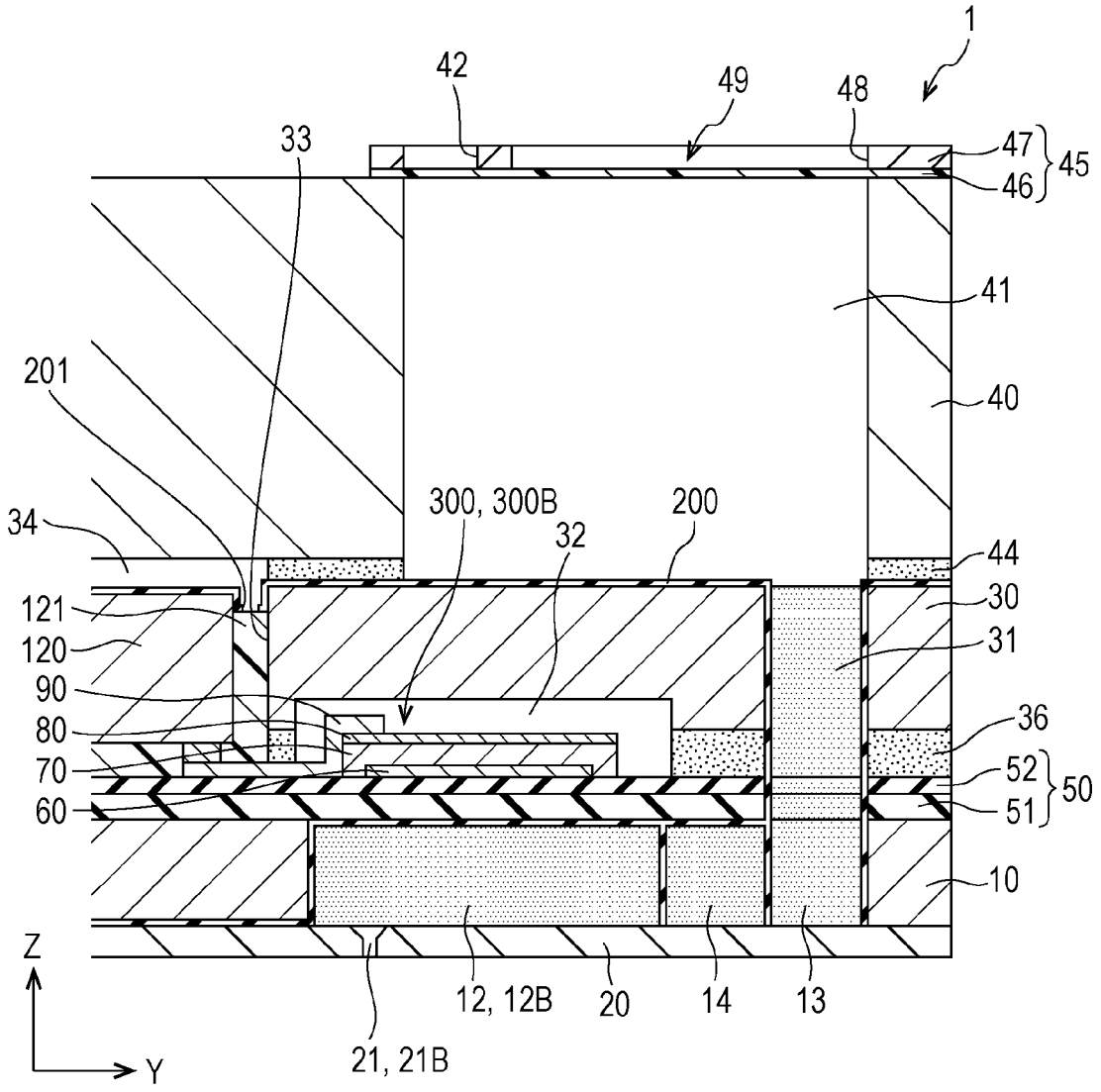
FIG. 4 is an enlarged cross-sectional view of the main part of the recording head according to Embodiment 1 of the invention.

FIG. 1 is an exploded perspective view of an ink jet type recording head which is an example of a liquid ejecting head according to Embodiment 1 of the invention, FIG. 2 is a plan view of a flow path forming substrate of the ink jet type recording head, FIG. 3 is a cross-sectional view of the ink jet type recording head conforming to a line III-III of FIG. 2, and FIG. 4 is an enlarged view of a main part of FIG. 3.

As shown in the drawing, as a flow path forming substrate 10 constituting an ink jet type recording head 1 (hereinafter, simply referred to as recording head 1), a metal such as stainless steel, nickel (Ni), ceramic materials represented by zirconium oxide ($ZrO_X$) or aluminum oxide ($Al_XO_Y$), glass ceramic materials, oxide such as silicon oxide ($SiO_X$), magnesium oxide (MgO), lanthanum aluminate ($LaAlO_3$), or the like can be used. In the embodiment, the flow path forming substrate 10 is made of a silicon single crystal substrate.

The flow path forming substrate 10 is anisotropically etched from one surface side so that pressure generation chambers 12 which are recessed portions partitioned by a plurality of partition walls are disposed in parallel along the first direction X in which a plurality of nozzles 21 for ejecting ink are disposed in parallel. In addition, in the flow path forming substrate 10, a plurality of rows in which the pressure generation chambers 12 are disposed in parallel in the first direction are provided in the second direction Y, and two rows are provided in the embodiment. In the embodiment, the pressure generation chambers 12 constituting one row are referred to as a first pressure generation chamber 12A, and the pressure generation chambers 12 constituting the other row are referred to as a second pressure generation chamber 12B. In addition, in the flow path forming substrate 10, an ink supply path 14 and a first liquid supply chamber 13 are partitioned by partition walls on one end side of the pressure generation chamber 12 in the second direction Y. That is, in the embodiment, the flow path forming substrate 10 is provided with the pressure generation chamber 12, the ink supply path 14, and the first liquid supply chamber 13 as individual flow paths communicating with the respective nozzles 21. That is, the first liquid supply chamber 13 of the embodiment is provided independently in each of the pressure generation chambers 12. In the embodiment, although the first liquid supply chamber 13 is provided independently in each of the pressure generation chambers 12, the invention is not limited thereto, and the first liquid supply chamber 13 may be provided so as to communicate in common with a plurality of pressure generation chambers 12. That is, the first liquid supply chamber 13 may constitute a portion of the common liquid chamber communicating in common with the plurality of individual flow paths.

The ink supply path 14 is formed with a width narrower than that of the pressure generation chamber 12 in the first direction X, and keeps the flow path resistance of the ink flowing from the first liquid supply chamber 13 into the pressure generation chamber 12 constant. The ink supply path 14 is not limited to the configuration that narrows the width, and the height in the third direction Z may be narrowed.

In addition, protective films 200 having liquid resistance (ink resistance) are provided on inner wall surfaces of the pressure generation chamber 12, the first liquid supply chamber 13, and the ink supply path 14 of the flow path forming substrate 10. The liquid resistance (ink resistance) referred to herein means etching resistance to alkaline ink. As such a protective film 200, for example, a single layer or a laminate of at least one material selected from tantalum oxide ($TaO_X$), zirconium oxide ($ZrO_X$), nickel (Ni), and chromium (Cr) can be used. In the embodiment, tantalum oxide ($TaO_X$) is used as the protective film.

A nozzle plate 20 in which a nozzle 21 communicating with the vicinity of an end portion of each pressure generation chamber 12 on the side opposite to the ink supply path 14 is formed therein is fixed to the surface of the flow path forming substrate 10 on the side where the pressure generation chamber 12 is opened by an adhesive, a heat welding film, or the like. As the nozzle plate 20, a metal such as stainless steel, nickel (Ni), a silicon single crystal substrate, ceramic materials represented by zirconium oxide ($ZrO_X$) or aluminum oxide ($Al_XO_Y$), glass ceramic materials, oxide such as silicon oxide ($SiO_X$), magnesium oxide (MgO), lanthanum aluminate ($LaAlO_3$), or the like can be used. In the nozzle plate 20, two rows of nozzle rows, a first nozzle row in which a first nozzle 21A communicating with the first pressure generation chamber 12A are disposed in parallel in the first direction X and a second nozzle row in which a second nozzle 21B communicating with the second pressure generation chamber 12B are disposed in parallel in the first direction X, are disposed in parallel in the second direction Y.

On the other hand, a vibration plate 50 is formed on the surface of the flow path forming substrate 10 opposite to the nozzle plate 20. The vibration plate 50 of the embodiment is provided with an elastic film 51 including silicon oxide ($SiO_X$) provided on the flow path forming substrate 10 side, an insulator film 52 including zirconium oxide ($ZrO_X$) provided on the elastic film 51. In the embodiment, the elastic film 51 containing silicon dioxide ($SiO_2$) and the insulator film 52 containing zirconium oxide ($ZrO_2$) are used. The pressure generation chamber 12, the first liquid supply chamber 13, and the ink supply path 14 are formed by anisotropically etching the flow path forming substrate 10 from the surface side to which the nozzle plate 20 is bonded, and the surface of the pressure generation chamber 12 opposite to the nozzle plate 20 is partitioned by the elastic film 51.

The vibration plate 50 may be provided with only one of the elastic film 51 and the insulator film 52, or may be further provided with other film in addition to the elastic film 51 and the insulator film 52. In addition, the vibration plate 50 is not limited to the one including silicon oxide and zirconium oxide, and for example, silicon nitride (SiN), titanium oxide ($TiO_X$) or the like may be used. That is, as the vibration plate 50, a single layer or a laminate of at least one material selected from silicon oxide, zirconium oxide, silicon nitride, and titanium oxide can be used.

On the vibration plate 50 of the flow path forming substrate 10, a first electrode 60, a piezoelectric layer 70, and a second electrode 80 are laminated by film formation and lithography to form a piezoelectric element 300. In the embodiment, the piezoelectric element 300 is a drive element that causes pressure change in the ink in the pressure generation chamber 12. Here, the piezoelectric element 300 is referred to as a piezoelectric actuator, and is a portion including the first electrode 60, the piezoelectric layer 70, and the second electrode 80. In general, one of the electrodes of the piezoelectric element 300 is used as a common electrode common to the plurality of piezoelectric elements 300, and the other electrode is configured as an individual electrode independent for each piezoelectric element 300. In the embodiment, the first electrode 60 is used as a common electrode and the second electrode 80 is used as an individual electrode, but this configuration may be reversed.

As the first electrode 60, for example, a noble metal such as platinum (Pt), iridium (Ir), conductive oxides represented by lanthanum nickel oxide (LNO), iridium oxide ($IrO_2$) and the like, or a laminated film thereof, which is a material capable of maintaining conductivity without oxidizing when forming the piezoelectric layer 70, is preferably used.

In addition, as the first electrode 60, an adhesion layer for securing adhesion strength between the above-described conductive material and the vibration plate 50 may be used. In the embodiment, although not shown, titanium is used as the adhesion layer. As the adhesion layer, zirconium, titanium, titanium oxide, or the like can be used. That is, in the embodiment, the first electrode 60 is formed of an adhesion layer made of titanium and at least one conductive layer selected from the above-described conductive materials.

The piezoelectric layer 70 is made of an oxide piezoelectric material having a polarization structure formed on the first electrode 60, may be made of, for example, a perovskite oxide represented by the general formula $ABO_3$, and a lead-based piezoelectric material containing lead, a lead-free piezoelectric material containing no lead, or the like can be used. The piezoelectric layer 70 can be formed by a liquid phase method such as a sol-gel method and a metal-organic decomposition (MOD) method, a physical vapor deposition (PVD) method (vapor phase method) such as a sputtering method, and a laser ablation method, for example.

It is desirable that the second electrode 80 can favorably form an interface with the piezoelectric layer 70, and is a material that can exhibit conductivity and piezoelectric characteristics. As the second electrode 80, a noble metal material such as iridium (Ir), platinum (Pt), palladium (Pd), and gold (Au), or a conductive oxide represented by lanthanum nickel oxide (LNO) is preferably used. In addition, the second electrode 80 may be a laminate of a plurality of materials. In the embodiment, a laminated electrode of iridium and titanium (iridium is in contact with piezoelectric layer 70) is used. The second electrode 80 can be formed by a physical vapor deposition (PVD) method (vapor phase method) such as a sputtering method, a liquid phase method such as a sol-gel method and a metal-organic decomposition (MOD) method, and a plating method. In addition, by performing heat treatment after forming the second electrode 80, characteristics of the piezoelectric layer 70 can be improved.

Such a second electrode 80 is formed only on the piezoelectric layer 70, that is, only on the surface of the piezoelectric layer 70 on the side opposite to the flow path forming substrate 10.

In the embodiment, the piezoelectric element 300 corresponding to the first pressure generation chamber 12A constituting one row is referred to as a first piezoelectric element 300A, and the piezoelectric element 300 corresponding to the second pressure generation chamber 12B constituting the other row is referred to as a second piezoelectric element 300B. That is, in the flow path forming substrate 10, two rows of the row of the first piezoelectric element 300A and the row of the second piezoelectric element 300B disposed in parallel in the first direction X are provided in the second direction Y.

In addition, a lead electrode 90 made of, for example, gold (Au) or the like is provided from the second electrode 80 of the piezoelectric element 300. One end portion of the lead electrode 90 is connected to the second electrode 80 and the other end portion extends to the side opposite to the ink supply path 14 of the flow path forming substrate 10. That is, the lead electrode 90 extends between the first piezoelectric element 300A and the second piezoelectric element 300B in the second direction Y. A drive circuit 120 made of a semiconductor integrated circuit (IC) for driving the piezoelectric element 300 described in detail later is flip-chip mounted on the leading end portion of the extended lead electrode 90. That is, the drive circuit 120 is mounted between the first piezoelectric element 300A and the second piezoelectric element 300B.

In addition, as shown in FIG. 2, an input wiring 122 is provided on the vibration plate 50 of the flow path forming substrate 10. One end of the input wiring 122 is connected to the drive circuit 120, the other end is extended to one end of the flow path forming substrate 10 in the second direction Y, an external wiring 130 for supplying a signal for controlling the driving of the recording head 1 is connected to the leading end portion of the extended input wiring 122. The external wiring 130 is, for example, a flexible cable such as flexible flat cable (FFC) or flexible printed circuits (FPC). A signal from the external wiring 130 is supplied to the drive circuit 120 via the input wiring 122.

Furthermore, a protective substrate 30 is bonded to the surface of the flow path forming substrate 10 on the piezoelectric element 300 side. In the embodiment, the flow path forming substrate 10 and the protective substrate 30 are bonded using an adhesive 36. As the protective substrate 30, a metal such as stainless steel, nickel (Ni), a silicon single crystal substrate, ceramic materials represented by zirconium oxide ($ZrO_X$) or aluminum oxide ($Al_XO_Y$), glass ceramic materials, oxide such as silicon oxide ($SiO_X$), magnesium oxide (MgO), lanthanum aluminate ($LaAlO_3$), or the like can be used. As such a protective substrate 30, a material having the same linear expansion coefficient as that of the flow path forming substrate 10 is preferable. Incidentally, in a case where the protective substrate 30 is made of a material having a greatly different linear expansion coefficient from that of the flow path forming substrate 10, by being heated or cooled, warpage occurs due to a difference in linear expansion coefficient between the flow path forming substrate 10 and the protective substrate 30. In the embodiment, warpage due to heat can be inhibited by using the same material as the flow path forming substrate 10, that is, a silicon single crystal substrate as the protective substrate 30.

In addition, the protective substrate 30 is provided with a second liquid supply chamber 31 which is a flow path for supplying ink to the first liquid supply chamber 13 of the flow path forming substrate 10. The second liquid supply chamber 31 is provided with a size communicating in common with a plurality of first liquid supply chambers 13. That is, the opening of the second liquid supply chamber 31 on the flow path forming substrate 10 side is provided continuously over the plurality of first liquid supply chambers 13 disposed in parallel in the first direction X, and configures a portion of a common flow path communicating with a plurality of individual flow paths.

In addition, in the embodiment, the flow path forming substrate 10 provided with the recessed portion represented by the pressure generation chamber 12, the vibration plate 50, the piezoelectric element 300, and the protective substrate 30 are collectively referred to as a piezoelectric device.

On the other hand, a piezoelectric element holding portion 32 is provided in a region of the protective substrate 30 opposed to the piezoelectric element 300. Since the piezoelectric element 300 is formed in the piezoelectric element holding portion 32, the piezoelectric element 300 is protected in a state hardly affected by the external environment. The piezoelectric element holding portion 32 may be sealed or not sealed.

In addition, a drive circuit holding portion 33 is provided between the piezoelectric element holding portions 32 of the protective substrate 30. The drive circuit holding portion 33 is provided penetrating the protective substrate 30 in the third direction Z which is the thickness direction, and the drive circuit 120 for driving the piezoelectric element 300 is provided inside the drive circuit holding portion 33.

Here, one opening of the drive circuit holding portion 33 penetrating in the third direction Z of the protective substrate 30 is closed with the flow path forming substrate 10, and the other opening is covered with a case member 40 which is a flow path member. The drive circuit 120 is held in a space 34 formed by the protective substrate 30, the flow path forming substrate 10, and the case member 40 in this manner. Incidentally, since the thickness of the drive circuit 120 of the embodiment in the third direction Z is thinner than the thickness of the protective substrate 30, even when the drive circuit 120 is mounted in the space 34, the drive circuit 120 does not protrude toward the case member 40 side of the protective substrate 30. Therefore, in the space 34, a gap is formed between the drive circuit 120 and the case member 40.

Incidentally, as the drive circuit 120, one having a thicker thickness in the third direction Z than that of the protective substrate 30 may be used. As the drive circuit 120, one having the thicker thickness in the third direction Z than that of the protective substrate 30 is used, so that when the drive circuit 120 is mounted on the flow path forming substrate 10 in a state where the protective substrate 30 is bonded to the flow path forming substrate 10, handling is improved in the drive circuit 120 and mounting accuracy can be improved. In a case where one having the thicker thickness in the third direction Z than that of the protective substrate 30 is used as the drive circuit 120, a recessed portion that opens on the protective substrate 30 side of the case member 40 may be provided.

In addition, a filler 121 which is an underfill agent is filled between the drive circuit 120, the flow path forming substrate 10 (vibration plate 50) and the protective substrate 30.

That is, the filler 121 is filled between the drive circuit 120 and the flow path forming substrate 10 (vibration plate 50) and between the drive circuit 120 and the inner wall surface of the drive circuit holding portion 33 of the protective substrate 30. In addition, on the side opposite to the flow path forming substrate 10, the filler 121 is disposed with a gap therebetween, without abutting on the case member 40. That is, the filler 121 filled between the drive circuit 120 and the protective substrate 30 is filled to a height lower than the thickness in the third direction Z of the protective substrate 30 on the flow path forming substrate 10 side.

The underfill agent used as the filler 121 is a liquid curable resin, and examples thereof include an epoxy resin, a polyurethane resin, a silicone resin, a polyester resin, and the like.

In addition, the above-described protective film 200 is formed on the inner wall of the second liquid supply chamber 31 of the protective substrate 30. That is, the protective films 200 are formed on the inner walls of the flow paths of the pressure generation chamber 12 of the flow path forming substrate 10 and the protective substrate 30, the ink supply path 14, the first liquid supply chamber 13, and the second liquid supply chamber 31.

The protective film 200 is continuously provided from the inner wall of the second liquid supply chamber 31 to at least the boundary portion between the inner wall of the second liquid supply chamber 31 and a bonding surface with the case member 40 of the protective substrate 30. The protective film 200 is provided to the boundary portion of the bonding surface of the case member 40 of the protective substrate 30 in this manner, so that it is possible to inhibit the protective substrate 30 from being etched by the ink that has entered the bonding interface, to inhibit the lowering of the bonding strength, and to inhibit the peeling of the protective substrate 30 from the case member 40. Incidentally, if the protective film 200 is not formed, the protective substrate 30 is etched by the ink that has entered the bonding interface between the protective substrate 30 and the case member 40, and problems such as peeling of the protective substrate 30 from the case member 40 due to leakage of ink or lowering of bonding strength occur.

In the embodiment, the protective film 200 is continuously provided over the entire surface of the bonding surface of the protective substrate 30 to the case member 40. It goes without saying that the protective film 200 may be formed only at the boundary portion between the inner wall of the second liquid supply chamber 31 of the protective substrate 30 and the bonding surface of the protective substrate 30 to the case member 40. That is, the protective film 200 may not be formed on the drive circuit 120 side which is the bonding surface of the protective substrate 30 to the case member 40.

Such a protective film 200 has an exposure hole 201 exposing at least a portion of the surface of the filler 121. Here, the surface of the filler 121 refers to a surface that is not in contact with members such as the drive circuit 120, the protective substrate 30, the case member 40, and the like. In other words, the surface of the filler 121 refers to a portion other than the portion formed between two surfaces facing each other between the two members so as to be in contact with the two surfaces. That is, on two surfaces facing each other, the surface of the filler 121 formed so as to be in contact with one surface and the surface of the filler 121 which is not in contact with the other surface is referred to as a surface. The filler 121 is provided between the drive circuit 120 and the inner wall surface of the drive circuit holding portion 33 of the protective substrate 30, and the surface of the filler 121 of the embodiment is a surface opposed to the case member 40.

The exposure hole 201 of the protective film 200 is formed so as to expose the surface of the filler 121 without covering a portion of the surface of the filler 121. The exposure hole 201 may be formed to have a size to expose the entire surface of the filler 121, and may be formed in a portion of the surface of the filler 121 to be formed to have a size to expose only a portion of the surface.

In a case where the exposure hole 201 is formed to have the size to expose only a portion of the surface of the filler 121, the number of exposure holes 201 is not limited to one, and may be two or more. In particular, in the embodiment, since the elongated drive circuit 120 is used in the second direction Y, it is preferable that a plurality of exposure holes 201 be disposed in parallel in the second direction Y.

In addition, the exposure hole 201 may be a crack penetrating the protective film 200 in the thickness direction. For example, the exposure hole 201 having such a crack can be formed by a difference in linear expansion coefficient between the filler 121 and the protective film 200 by heat treatment after forming the protective film 200 over the surface of the filler 121. That is, by using a material having a linear expansion coefficient higher than that of the protective film 200 as the filler 121, it is possible to form the exposure hole 201 made of cracks in the protective film 200 by heating. Even if the exposure hole 201 is formed of linear cracks, it is possible to discharge the gas emitted from the filler 121 described in detail later through the exposure hole 201 of the crack.

Here, an organic gas is generated as a degassing component from an underfill agent such as an epoxy resin, a polyurethane resin, a silicone resin, and a polyester resin used as the filler 121. The gas generated from the filler 121 in this manner is discharged into the space 34 through the exposure hole 201 of the protective film 200. By discharging the gas generated from the filler 121 into the space 34 in this manner, it is difficult for the gas generated from the filler 121 to move to the terminal portion side connected to the lead electrode 90 of the drive circuit 120. It is possible to inhibit occurrence of contamination by gas at the terminal of the drive circuit 120 and to inhibit short-circuiting or dielectric breakdown of the wiring. In addition, since the gas generated from the filler 121 can be discharged from the exposure hole 201, it is difficult for the gas generated from the filler 121 to move to the bonding surface side between the drive circuit 120 and the flow path forming substrate 10, and it is possible to inhibit occurrence of migration due to deterioration of the adhesion of the bonding surface.

Incidentally, if the surface of the filler 121 is entirely covered with the protective film 200, it is difficult for the gas emitted from the filler 121 to be discharged into the space 34 by the protective film 200, and it is easy to move the interface between the filler 121 and the bonded member. Therefore, the gas emitted from the filler 121 moves to the terminal portion of the drive circuit 120 and the bonding interface between the drive circuit 120 and the flow path forming substrate 10, and problems are likely to occur.

The space 34 in which the drive circuit 120 is held may be sealed or not sealed. For example, even if the space 34 is sealed, since the gas contained in the filler 121 is held in the space 34, it is difficult for the gas to move to the terminal portion of the drive circuit 120 and the bonding interface with the flow path forming substrate 10.

In addition, in this embodiment, the protective film 200 is formed on the surface of the drive circuit 120 on the side of the case member 40. Incidentally, the protective film 200 may not be formed on the surface of the drive circuit 120 on the side of the case member 40.

Figure 5:
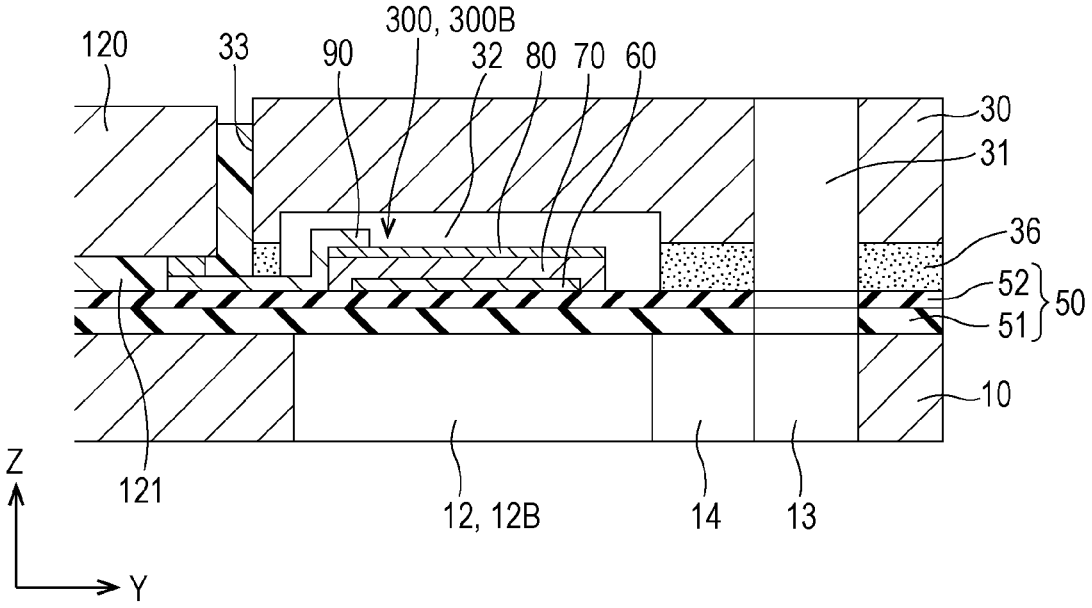
FIG. 5 is a view showing a method of manufacturing the recording head according to Embodiment 1 of the invention.
Figure 6:
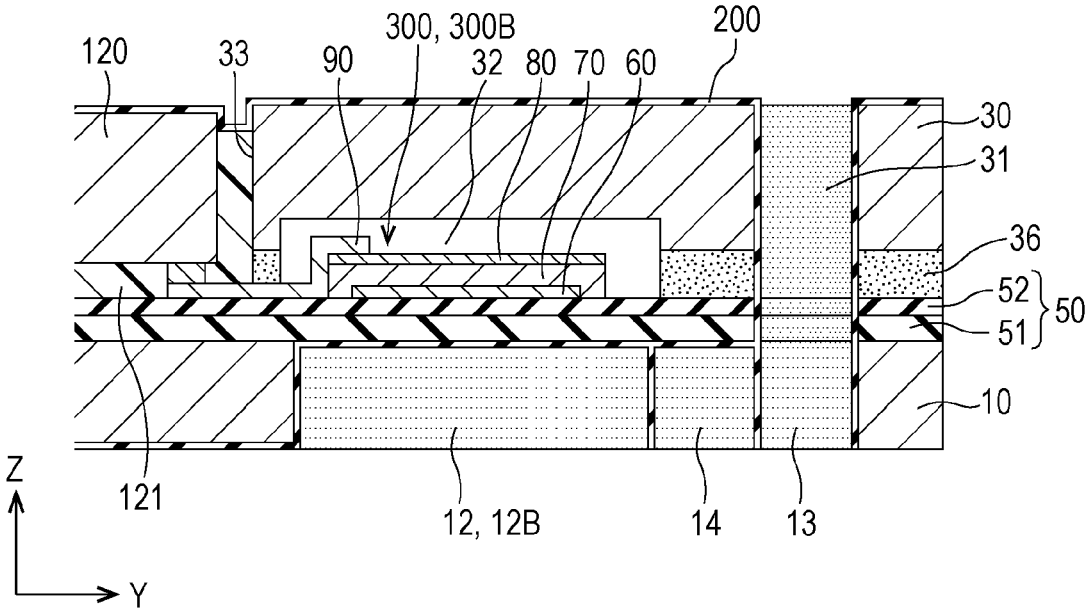
FIG. 6 is a view showing the method of manufacturing the recording head according to Embodiment 1 of the invention.
Figure 7:
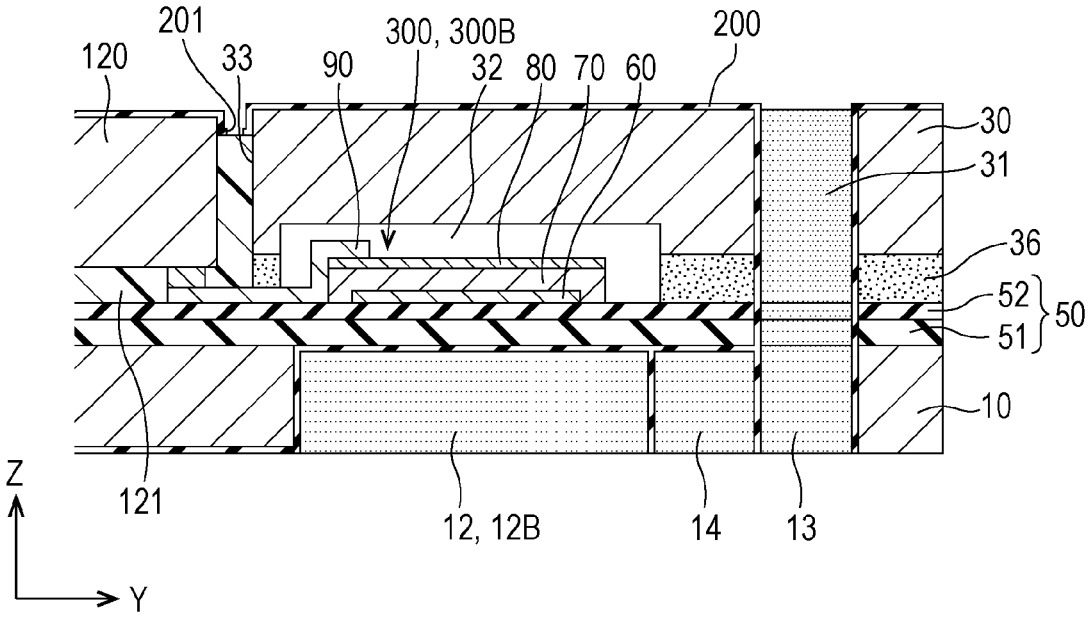
FIG. 7 is a view showing the method of manufacturing the recording head according to Embodiment 1 of the invention.

A method of manufacturing the recording head 1 having such a protective film 200 will be described with reference to FIGS. 5 to 7. FIGS. 5 to 7 are cross-sectional views showing a method of manufacturing the recording head.

As shown in FIG. 5, a bonded body obtained by bonding the flow path forming substrate 10, on which the vibration plate 50, the piezoelectric element 300, the lead electrode 90, and the like are formed, and the protective substrate 30 is formed. In the embodiment, the flow path forming substrate 10 and the protective substrate 30 are adhered to each other via the adhesive 36. Before or after bonding to the protective substrate 30, flow paths such as the pressure generation chamber 12, the first liquid supply chamber 13, the ink supply path 14, and the like are formed in the flow path forming substrate 10. In addition, before bonding to the flow path forming substrate 10, the second liquid supply chamber 31, the piezoelectric element holding portion 32, the drive circuit holding portion 33, and the like are formed in the protective substrate 30. In addition, the drive circuit 120 is mounted on the bonded body and the bonded body is filled with the filler 121. Here, it is preferable that the flow path forming substrate 10 and the protective substrate 30 be bonded to each other, and the drive circuit 120 be mounted on the flow path forming substrate 10 after and flow paths such as the pressure generation chamber 12, the first liquid supply chamber 13, the ink supply path 14, and the like be formed. This is because when the drive circuit 120 is mounted as much as possible in the subsequent process, the drive circuit 120 cannot be wasted due to failure of other processes since the drive circuit 120 is expensive, the yield can be improved, and the cost can be reduced.

Next, as shown in FIG. 6, the protective film 200 is formed on the bonded body obtained by bonding the flow path forming substrate 10 and the protective substrate 30 and on which the drive circuit 120 is mounted and filled with the filler 121 by a vapor phase method such as a chemical vapor deposition (CVD) method. That is, the protective film 200 is continuously formed over the bonding surface between the inner wall surface of the flow paths of the pressure generation chamber 12, the first liquid supply chamber 13, the ink supply path 14, and the second liquid supply chamber 31, and the case member 40 of the protective substrate 30, the surface of the filler 121, and the drive circuit 120. By bonding the flow path forming substrate 10 and the protective substrate 30 and forming the protective film 200 in a state where the flow path is formed in this manner, the protective film 200 can be formed over the surface of the adhesive 36 for bonding the flow path forming substrate 10 and the protective substrate 30 from the inner wall surface of the flow path. Therefore, by protecting the adhesive 36 with the protective film 200, it is possible to inhibit the adhesive 36 from being etched and dropped off by ink and being foreign matter. In addition, since the adhesive interface of the adhesive 36 can be protected by the protective film 200, it is possible to inhibit the penetration of ink into the adhesive interface of the adhesive 36, and to inhibit the reduction in bonding strength.

Incidentally, although it may be considered to perform the step of forming the protective film 200 before mounting the drive circuit 120, a step of removing unnecessary protective film 200 formed on lead electrode 90 or the like is necessary. There is a possibility that when the protective film 200 on the wiring such as the lead electrode 90 is etched, problems such as an excessive etching of the wiring, a decrease in the thickness of the wiring, and an increase in the electric resistance value of the wiring may occur. Furthermore, there is a possibility that the etched wiring material adheres to the wiring hall and causes migration. In the embodiment, since the protective film 200 is formed after the drive circuit 120 is mounted on the flow path forming substrate 10 and the filler 121 is filled, it is not necessary to remove the protective film 200 on the wiring such as the lead electrode 90 by etching and it is possible to inhibit the decrease in the thickness of the wiring to inhibit the increase in the electric resistance value of the wiring. In addition, mounting failure of the drive circuit 120 and filling failure of the filler 121 can be inhibited.

Next, as shown in FIG. 7, the protective film 200 formed on the surface of the filler 121 is removed by, for example, dry etching, thereby forming the exposure hole 201.

For example, when forming the exposure hole 201 by dry etching, it is preferable not to remove the protective film 200 on the drive circuit 120 by etching so that the drive circuit 120 is not over-etched. By inhibiting the drive circuit 120 from being etched in this manner, it is possible to reduce the thickness of the exterior protecting the interior of the drive circuit 120, so that the drive circuit 120 can be downsized.

In order to inhibit the drive circuit 120 from being etched, it is preferable to leave the protective film 200 on the drive circuit 120 side of the surface of the filler 121. This is because the surface of the drive circuit 120 may be etched due to the positional deviation of the mask or the like in a case of forming the exposure hole 201 having a size to expose the entire surface of the filler 121, for example. That is, it is preferable that the exposure hole 201 be provided so as to expose only a portion of the filler 121, and it is preferable to protect the drive circuit 120 side of the surface of the filler 121 with the protective film 200. As a result, it possible to inhibit the drive circuit 120 from being etched even if the positional deviation of the exposure hole 201 is occurred due to the positional deviation of the mask.

In addition, on the protective substrate 30, the case member 40 which is the flow path member of the embodiment is fixed. In the embodiment, the case member 40 is bonded onto the protective substrate 30 via an adhesive 44.

A third liquid supply chamber 41 communicating with the second liquid supply chamber 31 of the protective substrate 30 is formed in the case member 40. In the embodiment, the third liquid supply chamber 41 is provided penetrating the case member 40 in the third direction Z which is the lamination direction. An opening of the third liquid supply chamber 41 on the protective substrate 30 side has an opening larger than that of the second liquid supply chamber 31 and a portion of the opening of the third liquid supply chamber 41 on the protective substrate 30 side is sealed with the surface of the protective substrate 30 on the case member 40 side.

The space 34 for holding the drive circuit 120 is formed by bonding the case member 40 to the surface of the protective substrate 30 opposite to the flow path forming substrate 10.

Furthermore, a compliance substrate 45 including a sealing film 46 and a fixing plate 47 is bonded to a surface of the case member 40 opposite to the protective substrate 30 on which the third liquid supply chamber 41 is opened. The sealing film 46 is made of a material having low rigidity and flexibility (for example, polyphenylene sulfide (PPS) film having a thickness of 6 μm), and one surface of the third liquid supply chamber 41 is sealed by the sealing film 46. In addition, the fixing plate 47 is formed of a hard material such as metal. Since a region of the fixing plate 47 facing the third liquid supply chamber 41 is an opening 48 completely removed in the thickness direction, one surface of the third liquid supply chamber 41 is a compliance portion 49 sealed only with the sealing film 46 having the flexibility.

In addition, the compliance substrate 45 is provided with an ink introduction port 42 penetrating in the thickness direction, and ink is supplied from an external ink supply unit (not shown) to the third liquid supply chamber 41 via the ink introduction port 42. That is, in the recording head 1 of the embodiment, after ink is taken in from then external ink supply unit (not shown) via the ink introduction port 42, and the interior thereof is filled with ink from the third liquid supply chamber 41 to the nozzle 21, a voltage is applied between each of the first electrode 60 and the second electrode 80 corresponding to the pressure generation chamber 12 according to the recording signal from the drive circuit 120, and the piezoelectric element 300 and the vibration plate 50 are bent and deformed. Therefore, the pressure in each pressure generation chamber 12 increases, and ink is discharged from the nozzle 21.

As described above, the ink jet type recording head 1, which is a typical example of the liquid ejecting head of the embodiment, includes the nozzle plate 20 on which a first nozzle row including a first nozzle 21A ejecting an ink which is a liquid and a second nozzle row including a second nozzle 21B ejecting an ink are formed, the flow path forming substrate 10 on which a first pressure generation chamber 12A communicating with the first nozzle 21A and a second pressure generation chamber 12B communicating with the second nozzle 21B are formed, the vibration plate 50 that is formed on one surface side of the flow path forming substrate 10, the first piezoelectric element 300A that is provided on the vibration plate 50 at a position corresponding to the first pressure generation chamber 12A, the second piezoelectric element 300B that is provided on the vibration plate 50 at a position corresponding to the second pressure generation chamber 12B, the protective substrate 30 that is bonded to the one surface side of the flow path forming substrate 10 and has the second liquid supply chamber 31 which is the flow path, the case member 40 which is the flow path member bonded to a side of the protective substrate 30 opposite to the flow path forming substrate 10, the drive circuit 120 that is mounted in the space 34 formed so as to be surrounded by the flow path forming substrate 10, the protective substrate 30, and the case member 40, between the first piezoelectric element 300A and the second piezoelectric element 300B of the flow path forming substrate 10 to drive the first piezoelectric element 300A and the second piezoelectric element 300B, the filler 121 that is filled between the drive circuit 120 and the flow path forming substrate 10, and between the drive circuit 120 and the protective substrate 30, and the protective film 200 that is formed from an inner wall of the second liquid supply chamber 31 of the protective substrate 30 to a boundary side with at least the inner wall of a bonding surface of the protective substrate 30 with the case member 40, in which the protective film 200 has then exposure hole 201 exposing at least a portion of a surface of the filler 121.

By providing the exposure hole 201 in the protective film 200 as described above, it is possible to discharge the gas generated from the filler 121 into the space 34 from the exposure hole 201. Therefore, it is possible to inhibit the gas emitted from the filler 121 from moving to the terminal portion of the drive circuit 120 and the bonding interface side between the drive circuit 120 and the flow path forming substrate 10, and to inhibit occurrence of contamination by gas at the terminal portion of the drive circuit 120. In addition, since it is difficult for the gas to move to the bonding interface between the drive circuit 120 and the flow path forming substrate 10, occurrence of migration due to deterioration of adhesion of the bonding surface by the gas can be inhibited.

In addition, it is preferable that the protective film 200 be extended on a portion of the surface of the filler 121, and the exposure hole 201 expose a portion of the surface of the filler 121. According to this configuration, when the protective film 200 is etched to form the exposure hole 201, it is possible to inhibit the drive circuit 120 from being etched even if the positional deviation of the mask is occurred.

In addition, the exposure hole 201 may be formed to have a size to expose the entire surface of the filler 121. According to this configuration, the opening area of the exposure hole 201 can be increased, and the gas generated from the filler 121 can be discharged into the space 34 via the exposure hole 201.

In addition, the exposure hole 201 may be the crack. That is, the exposure hole 201 may be formed by the crack.

Embodiment 2

Figure 8:
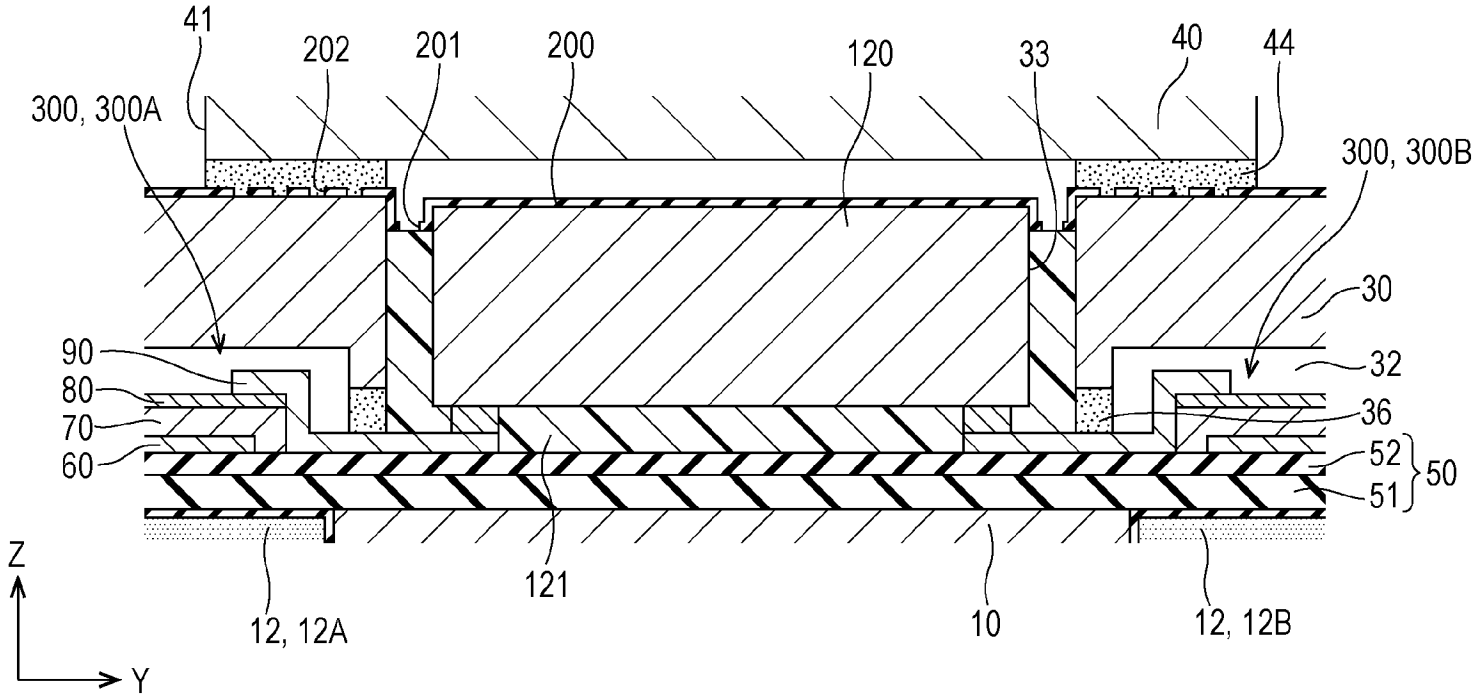
FIG. 8 is a cross-sectional view of a recording head according to Embodiment 2 of the invention.

FIG. 8 is a cross-sectional view of an ink jet type recording head which is an example of a liquid ejecting head according to Embodiment 2 of the invention. The same reference numerals are given to members similar to those in the above-described embodiment, and redundant explanations are omitted.

As shown in FIG. 8, in the recording head 1 of the embodiment, the recessed portion 202 is formed in the protective film 200 provided on the bonding surface of the protective substrate 30 with the case member 40.

The recessed portion 202 is not formed in the boundary portion between the bonding surfaces of the third liquid supply chamber 41 and the case member 40 but is formed in a portion other than the boundary. In the embodiment, a plurality of recessed portions 202 are disposed in parallel in the first direction X on the bonding surface of the protective substrate 30 with the case member 40.

Such a recessed portion 202 may be formed by completely removing the protective film 200 on the protective substrate 30 or may be formed so that a portion of the protective film 200 in the thickness direction remains on the bottom surface of the recessed portion 202. For example, by completely removing the protective film 200 to form the recessed portion 202, it is not necessary to strictly adjust the etching time of the recessed portion 202, and the manufacturing process can be simplified. In addition, by providing the protective film 200 such that a portion of the protective film 200 remains on the bottom surface of the recessed portion 202, the bonding interface of the protective substrate 30 is completely covered with the protective film 200. Therefore, it is possible to inhibit the protective substrate 30 from being etched by the ink entered from the bonding interface.

In addition, in a case where the protective film 200 is completely removed in the thickness direction as the recessed portion 202, it is preferable that the length of the protective film 200 at the boundary portion of the bonding surface between the inner surface of the second liquid supply chamber 31 and the case member 40 in the first direction X be longer than that of the other regions. As a result, it is possible to further inhibit the etching of the protective substrate 30 by the ink entered from the bonding interface.

As described above, in the embodiment, the protective film 200 formed on the bonding surface with the case member 40, which is the flow path member of the protective substrate 30, has a plurality of recessed portions 202. The plurality of recessed portions 202 are provided on the bonding surface of the protective film 200 with the case member 40 in this manner, so that the bonding area of the adhesive 44 is increased and the bonding strength between the protective substrate 30 and the case member 40 can be improved by an anchor effect. In addition, by providing the recessed portion 202, the length of the bonding interface in the first direction X is increased, and the penetration of ink from the bonding interface into the space 34 is inhibited, so that it is possible to inhibit the drive circuit 120 from being broken by the ink.

Embodiment 3

Figure 9:
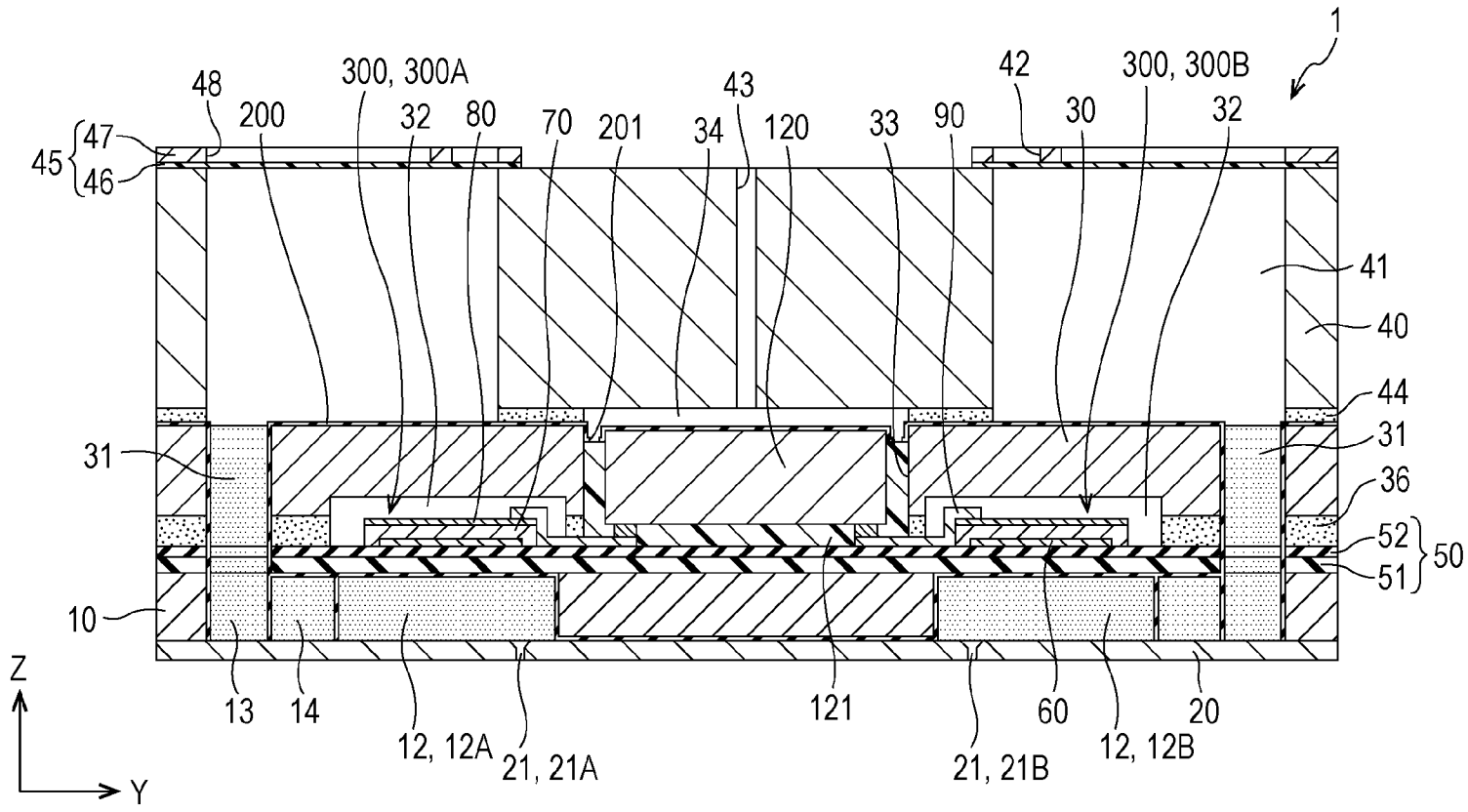
FIG. 9 is a cross-sectional view of a recording head according to Embodiment 3 of the invention.

FIG. 9 is a cross-sectional view of an ink jet type recording head which is an example of a liquid ejecting head according to Embodiment 3 of the invention. The same reference numerals are given to members similar to those in the above-described embodiment, and redundant explanations are omitted.

As shown in FIG. 9, an atmosphere release path 43 that communicates the space 34 holding the drive circuit 120 with the outside is formed in the case member 40, which is the flow path member of the embodiment. In the embodiment, the atmosphere release path 43 is provided penetrating the case member 40 in the third direction Z. That is, one end of the atmosphere release path 43 is provided so as to the space 34, and the other end thereof is provided so as to open on the side opposite to the protective substrate 30 of the case member 40.

In addition, in the protective film 200, similarly to Embodiment 1, the exposure hole 201 exposing at least a portion of the surface of the filler 121 is formed.

As described above, in the embodiment, the space 34 in which the drive circuit 120 is disposed is open to the atmosphere. In the embodiment, the atmosphere release path 43 is provided in the case member 40 to open the space 34 to the atmosphere, so that the gas discharged from the filler 121 into the space 34 can be discharged to the outside of the space 34. Therefore, it is possible to further inhibit the gas discharged from the filler 121 from moving to the terminal side of the drive circuit 120 and the bonding interface side between the drive circuit 120 and the flow path forming substrate 10.

In the embodiment, the atmosphere release path 43 is provided in the case member 40, but the invention is not particularly limited thereto, and for example, an atmosphere release path may be provided on one side or both sides of the protective substrate 30 in the second direction Y to communicate the space 34 with the outside. However, as in the embodiment, by providing the atmosphere release path so as to open on the surface opposite to the liquid ejection surface where the nozzle 21 for ejecting ink is opened, it is possible to inhibit the ink from entering the space 34 via the atmosphere release path.

Embodiment 4

Figure 10:
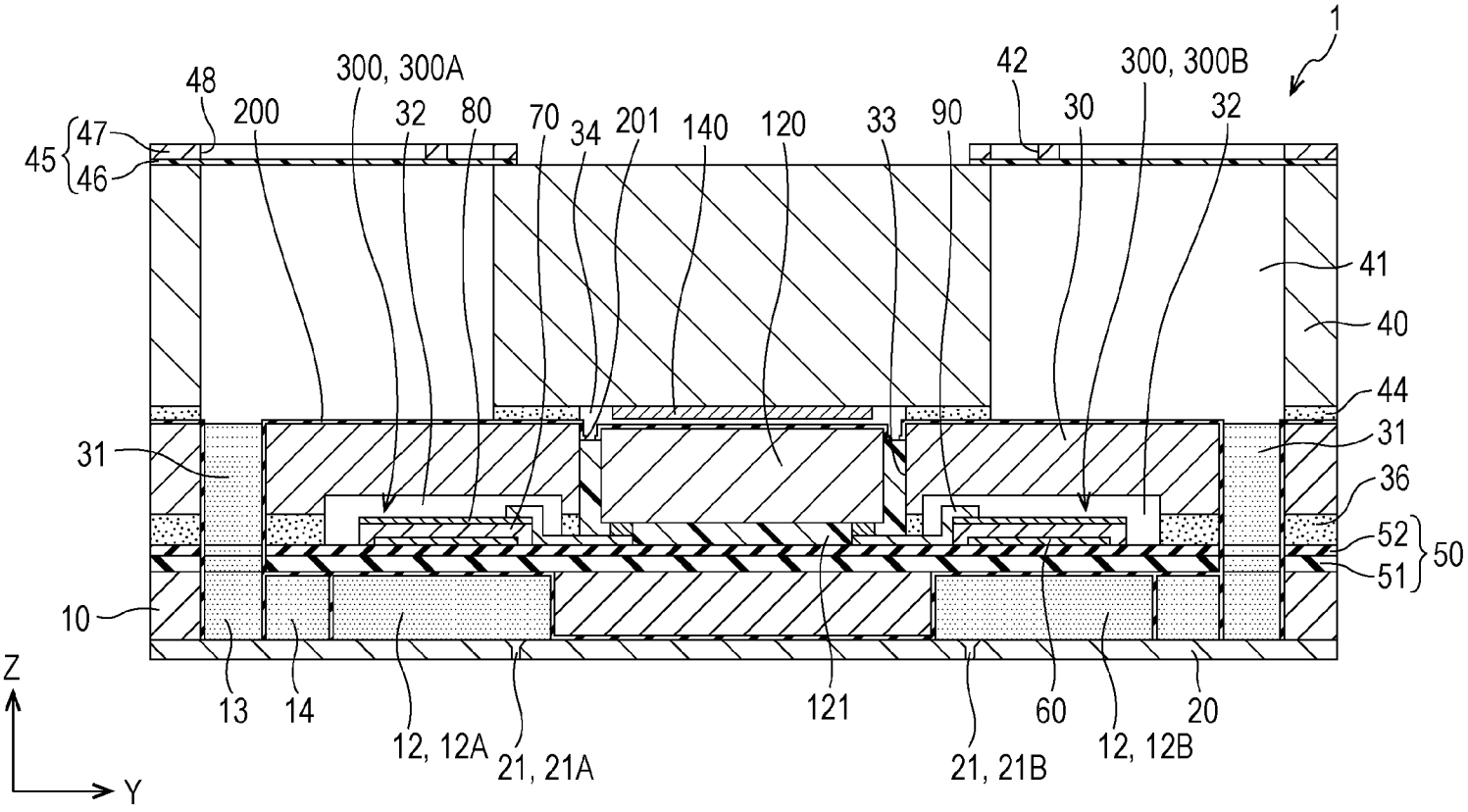
FIG. 10 is a cross-sectional view of a recording head according to Embodiment 4 of the invention.

FIG. 10 is a cross-sectional view of an ink jet type recording head which is an example of a liquid ejecting head according to Embodiment 4 of the invention. The same reference numerals are given to members similar to those in the above-described embodiment, and redundant explanations are omitted.

As shown in FIG. 10, an adsorbent 140 for adsorbing the gas discharged from the filler 121 is provided in the space 34 for holding the drive circuit 120 of the embodiment. In the embodiment, the adsorbent 140 is fixed to a surface of the case member 40 that faces the protective substrate 30. It goes without saying that the adsorbent 140 is not particularly limited as long as the adsorbent 140 is within the space 34, and may be fixed to the surface of the drive circuit 120 on the case member 40 side.

Such an adsorbent 140 is not particularly limited as long as the adsorbent 140 can adsorb organic gas discharged from the filler 121, and for example, activated carbon or the like can be used.

In addition, similarly to Embodiment 1, the exposure hole 201 exposing at least a portion of the surface of the filler 121 is formed in the protective film 200. In addition, the space 34 in which the adsorbent 140 is provided may be tightly sealed, or the space 34 may not be tightly sealed similarly to the above Embodiment 2.

As described above, in the embodiment, the space 34 in which the drive circuit 120 is disposed is provided with the adsorbent 140 that absorbs gas generated from the filler 121. In this manner, by providing the adsorbent 140 in the space 34, the gas discharged from the filler 121 can be adsorbed by the adsorbent 140. Therefore, it is possible to further inhibit the gas discharged from the filler 121 from moving to the terminal side of the drive circuit 120 and the bonding interface side between the drive circuit 120 and the flow path forming substrate 10.

Other Embodiment

Hereinbefore, although each of the embodiments of the invention is described, the basic configuration of the invention is not limited to the above-described embodiments.

In each of the embodiments described above, the ink supply path 14 and the first liquid supply chamber 13 are provided in the flow path forming substrate 10, but the invention is not limited thereto, and any one or both of the first liquid supply chamber 13 and the ink supply path 14 may not be disposed.

Furthermore, each of the above-described embodiments is described using the thin film type piezoelectric element 300 as a drive element that causes a pressure change in the pressure generation chamber 12, but the invention is not limited thereto. For example, it is possible to use a thick film type piezoelectric element formed by a method such as attaching a green sheet or the like, or a longitudinal vibration type piezoelectric element which alternately laminates a piezoelectric material and an electrode forming material to expand and contract in the axial direction. In addition, as the drive element, it is possible to use a device in which a heat generation element is disposed in the pressure generation chamber to discharge the liquid droplets from the nozzle by bubbles generated by heat generation of the heat generation element, or a so-called electrostatic actuator which generates static electricity between the vibration plate and the electrode and deforms the vibration plate by the electrostatic force to discharge the liquid droplets from the nozzle opening.

Figure 11:
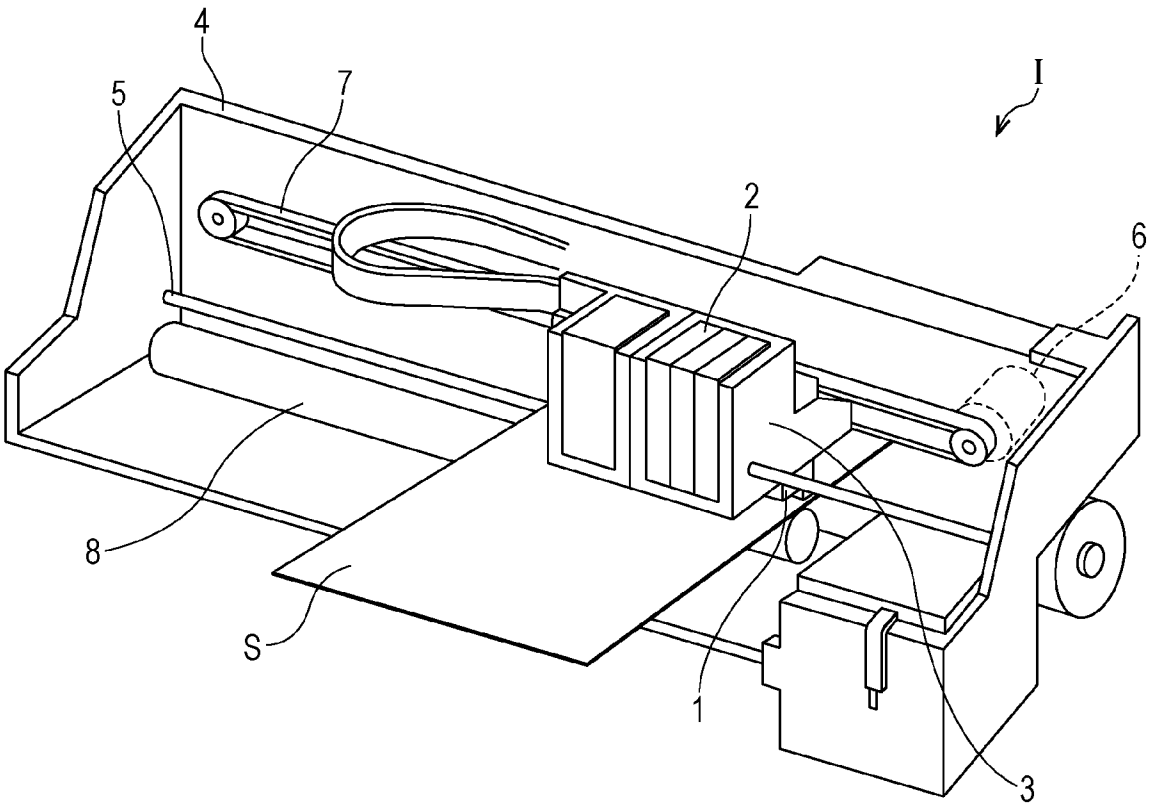
FIG. 11 is a view showing a schematic configuration of a recording apparatus according to an embodiment.

In addition, the ink jet type recording head 1 described above configures a portion of an ink jet type recording head unit having an ink flow path communicating with an ink cartridge or the like, and is mounted on an ink jet type recording apparatus. FIG. 11 is a schematic view showing an example of the ink jet type recording apparatus.

In the ink jet type recording apparatus I shown in FIG. 11, the plurality of recording heads 1 are detachably provided with an ink cartridges 2 constituting an ink supply unit, and a carriage 3 on which the recording head 1 is mounted is provided so as to be movable in the axial direction on a carriage shaft 5 attached to an apparatus main body 4.

The driving force of a drive motor 6 is transmitted to the carriage 3 through a plurality of gears (not shown) and a timing belt 7, so that the carriage 3 on which the recording head 1 is mounted is moved along the carriage shaft 5. On the other hand, the apparatus main body 4 is provided with a transport roller 8 as a transport unit, and a recording sheet S which is a recording medium such as paper is transported by the transport roller 8. The transport unit for transporting the recording sheet S is not limited to the transport roller, and may be a belt, a drum, or the like.

In the ink jet type recording apparatus I described above, the ink cartridge 2 as the ink supply unit is mounted on the carriage 3, but the invention is not particularly limited thereto. For example, the ink supply unit such as an ink tank may be fixed to the apparatus main body 4, and the ink supply unit and the recording head 1 may be connected via a supply tube such as a tube. In addition, the ink supply unit may not be mounted on the ink jet type recording apparatus.

In addition, in the ink jet type recording apparatus I described above, the recording head 1 is mounted on the carriage 3 and moves in the main scanning direction, but the invention is not limited thereto. For example, the invention can be applied to a so-called line type recording apparatus in which the recording head 1 is fixed and printing is performed by simply moving the recording sheet S such as paper in the sub-scanning direction.

Furthermore, the invention is broadly applied to liquid ejecting heads in general, and can be applied, for example, to a recording head such as various ink jet type recording heads used in an image recording apparatus such as a printer, a color material ejecting head used for manufacturing a color filter such as a liquid crystal display, an electrode material ejecting head used for forming an electrode of an organic EL display and an field emission display (FED), a bioorganic material ejecting head used for manufacturing biochip, and the like. In addition, although the ink jet type recording apparatus I is described as an example of a liquid ejecting apparatus, it can be used for the liquid ejecting apparatus using other liquid ejecting head described above.

What is claimed is:

1. A liquid ejecting head comprising:

a nozzle plate on which a first nozzle row including a first nozzle ejecting a liquid and a second nozzle row including a second nozzle ejecting a liquid are formed;

a flow path forming substrate on which a first pressure generation chamber communicating with the first nozzle and a second pressure generation chamber communicating with the second nozzle are formed;

a vibration plate that is formed on one surface side of the flow path forming substrate;

a first piezoelectric element that is provided on the vibration plate at a position corresponding to the first pressure generation chamber;

a second piezoelectric element that is provided on the vibration plate at a position corresponding to the second pressure generation chamber;

a protective substrate that is bonded to the one surface side of the flow path forming substrate and has a flow path;

a flow path member that is bonded to a side of the protective substrate opposite to the flow path forming substrate;

a drive circuit that is mounted in a space formed so as to be surrounded by the flow path forming substrate, the protective substrate, and the flow path member, between the first piezoelectric element and the second piezoelectric element of the flow path forming substrate to drive the first piezoelectric element and the second piezoelectric element;

a filler that is filled between the drive circuit and the protective substrate; and a protective film that is formed at least from a part of a face of the protective substrate and a part of a face of the drive circuit, wherein, when an area that overlaps the protective substrate and the filler is defined as an overlapping area, the protective film in the overlapping area has an exposure hole and the filler in the overlapping area does not have a corresponding exposure hole.

2. The liquid ejecting head according to claim 1, wherein the protective film extends to a portion of the surface of the filler, and the exposure hole exposes a portion of the surface of the filler.

3. The liquid ejecting head according to claim 1, wherein the protective film formed on the bonding surface of the protective substrate with the flow path member has a plurality of recessed portions.

4. The liquid ejecting head according to claim 1, wherein the space where the drive circuit is disposed is open to an atmosphere.

5. The liquid ejecting head according to claim 1, wherein an adsorbent that absorbs gas generated from the filler is provided in the space where the drive circuit is disposed.

6. A liquid ejecting apparatus comprising:

the liquid ejecting head according to claim 1.

7. A liquid ejecting apparatus comprising:

the liquid ejecting head according to claim 2.

8. A liquid ejecting apparatus comprising:

the liquid ejecting head according to claim 3.

9. A liquid ejecting apparatus comprising:

the liquid ejecting head according to claim 4.

10. A liquid ejecting apparatus comprising:

the liquid ejecting head according to claim 5.

11. A piezoelectric device which is used in a liquid ejecting head, comprising:

a flow path forming substrate on which a first recessed portion and a second recessed portion are formed;

a vibration plate that is formed on one surface side of the flow path forming substrate;

a first piezoelectric element that is provided on the vibration plate at a position corresponding to the first recessed portion;

a second piezoelectric element that is provided on the vibration plate at a position corresponding to the second recessed portion;

a protective substrate that is bonded to the one surface side of the flow path forming substrate and has a flow path;

a flow path member that is bonded to a side of the protective substrate opposite to the flow path forming substrate;

a drive circuit that is mounted in a space formed so as to be surrounded by the flow path forming substrate, the protective substrate, and the flow path member, between the first piezoelectric element and the second piezoelectric element of the flow path forming substrate to drive the first piezoelectric element and the second piezoelectric element;

a filler that is filled between the drive circuit and the protective substrate; and a protective film that is formed at least from a part of a face of the protective substrate and a part of a face of the drive circuit, wherein, when an area that overlaps the protective substrate and the filler is defined as an overlapping area, the protective film in the overlapping area has an exposure hole and the filler in the overlapping area does not have a corresponding exposure hole.

* * * * *